United States Patent [19]

Strohmeyer, Jr.

[11] Patent Number: 4,473,033

[45] Date of Patent: Sep. 25, 1984

[54] CIRCULATING FLUIDIZED BED STEAM GENERATOR HAVING MEANS FOR MINIMIZING MASS OF SOLID MATERIALS RECIRCULATED

[75] Inventor: Charles Strohmeyer, Jr., Gladwyne, Pa.

[73] Assignee: Electrodyne Research Corp., Gladwyne, Pa.

[21] Appl. No.: 592,455

[22] Filed: Mar. 22, 1984

Related U.S. Application Data

[63] Continuation-in-part of Ser. No. 519,190, Aug. 1, 1983, Pat. No. 4,453,495.

[51] Int. Cl.[3] ..... F22B 1/02

[52] U.S. Cl. ..... 122/4 D; 110/245; 165/104.16; 422/146

[58] Field of Search ..... 122/4 D; 110/245, 263, 110/347; 431/7, 170; 165/104.16; 422/146

[56] References Cited

U.S. PATENT DOCUMENTS

| | | | |
|---|---|---|---|
| 3,902,462 | 9/1975 | Bryers | 122/4 D |
| 4,145,848 | 3/1979 | Kulling | 34/57 A |
| 4,240,377 | 12/1980 | Johnson | 110/245 X |
| 4,250,839 | 2/1981 | Daman | 122/4 D |
| 4,336,769 | 1/1982 | Daman | 122/4 D |
| 4,397,267 | 8/1983 | Fink | 122/4 D |

*Primary Examiner*—Edward G. Favors

*Attorney, Agent, or Firm*—William J. Ruano

[57] ABSTRACT

The invention comprising a circulating fluidized bed firing system for a steam generator wherein the mass flow ratio for solid materials recirculated to hot gas flow employed to entrain and carry the recirculated solid materials to point/s of separation ranges from 6:1 to 2:1 at the furnace outlet and at rated conditions of the steam generator. Means are provided to cool the recirculated solids upstream and/or after separation of the recirculated solids from the gas stream. Conservative gas velocities for entrainment of solid particles in a range of from 16 to 25 ft./sec. at rated conditions of the steam generator minimize erosion of the coolant filled tubular heat exchange surface disposed in the gas stream upstream of the point of separation of solids from the gas stream.

5 Claims, 1 Drawing Figure

Figure 1:
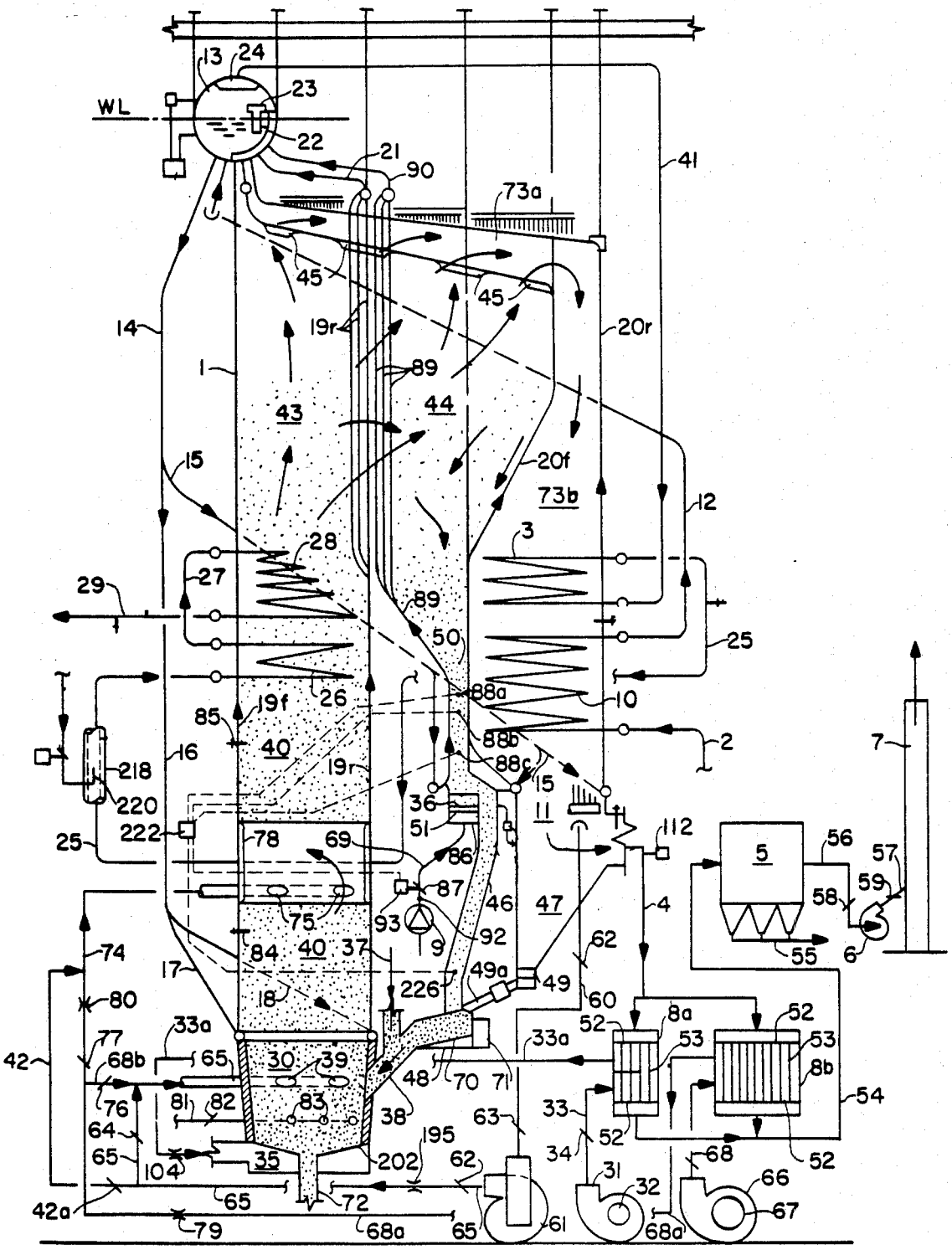

CIRCULATING FLUIDIZED BED STEAM GENERATOR HAVING MEANS FOR MINIMIZING MASS OF SOLID MATERIALS RECIRCULATED

This invention is a continuation-in-part to U.S. Patent Application Ser. No. 06/519,190 filed 08/01/83 U.S. Pat. No. 4,453,495.

This invention relates to means for improving the performance of steam generators having fluidized bed combustion systems.

The temperature of a circulating bed is maintained substantially below that of a conventional firing system (1,500° F. to 1,700° F. vs 2,500° F. to 3,000° F.). In order to hold the circulating bed temperature in a range of say 1,550° F., some means of cooling is required. Air, gas and heat exchange surface provide such cooling means. The inert material in the bed acts as a flywheel and maintains temperature uniform throughout the length of the circulating bed through storage and transport of heat to downstream points. The mass of the inert material is many times greater than that of the fuel. Heat is extracted from the combustion circuit by the heat exchange surface in contact with the gas and solid inert particles.

Where the inert material can be cooled along the gas path or after it is separated from the gas at the end of the circulation loop, it will then need to be raised in temperature at the head end of the circulating bed after reinjection as it mixes with available fuel and air flow. The inert material then has a greater cooling effect upon the combustion process and a lesser amount of inert material needs to be recirculated for stabilizing combustion temperature in the recirculation loop.

This invention coordinates the improvements described in the U.S. Patent Application to which this application is a continuation-in-part and establishes a more precise mass flow ratio for solid materials recirculated to hot gas flow employed to entrain and carry the recirculated solid material to point/s of separation, thereby minimizing the quantity of solid particles recirculated and reducing erosion upon fluid cooled heat absorption circuits disposed in the stream of recirculated solids and hot gases. Conservative gas velocities are employed to further reduce the erosion effects.

The present invention permits the circulating fluidized bed firing system to be utilized at the high end of the scale which is characterized by large amounts of superheating and reheating duty along with steam generation at high pressure. Superheating and reheating surface may be safely disposed in the stream of circulating solid materials and hot gas upstream of the point for separating the solid particles from the gas stream.

The circulating fluidized bed can thus avail itself of those characteristics of a conventional steam generator furnace which enables fast load changes to be made. In a conventional furnace, gas temperature declines as load and firing rate are decreased. For the circulating fluidized bed, recirculated solid particles are utilized in the high load range to limit rise of furnace temperature above a preset value as 1,550° F. As load is reduced the mass flow quantity of the recirculated particles can be deminished making less heat available to the fluid cooled heat absorption circuits.

Time constants associated with variations in solid particle mass flow recirculation rates closely parallel those associated with the inertial effects of stored heat in the heat exchange surface structural metals. The structural metal heat storage gives stability to the fluid circuit outlet temperatures. The hot recirculating particulate gives stability to the state of ignition within the overall combustion circuit.

It should be noted that in the circulating fluidized bed the whole recirculation loop is in a state of ignition and is not subject to a rapid flame out as can happen in a conventional firing system.

The phenomena of fluidized beds is not new. The application features described herein are the basis for unique claims.

For the apparatus and systems described herein, a specific object of this invention is to provide a circulating fluidized bed combustion system wherein solid inert material is circulated only as sufficient to maintain the temperature of the combustion process at a preset value as 1,550° F., minimizing the amount of solid inert material recirculated.

A further object is to provide a means for cooling the inert material during the recirculation process to further minimize the amount of solid inert material recirculated to limit the temperature of the combustion process to a preset value as above.

A still further object is to provide a means for cooling the solid circulating materials in the gas stream at the outlet of the combustion process in parallel with the gas stream by passing the solids and gas flow over tubular circuits disposed across the gas stream flow path, a fluid coolant being passed through the tubular circuits receiving heat from the solid material and gas flow.

A still further object is to provide a means for cooling the circulating solid materials after separation from the gas stream and before return to the combustion process.

A still further object is to maintain an effective mass flow ratio between the solid circulating materials and the gas stream conveying the solid circulating materials in a range of from 6:1 to 2:1 while maintaining conveying gas velocities in a range of from 16 to 25 feet per second to achieve the objectives listed above.

A still further objective is to provide a means for limiting air flow for combustion especially at partial load firing conditions through recirculation of spent hot combustion gases after cooling through the reactor/furnace to entrain a required amount of solid materials in the circulating loop of the fluidized bed.

The invention will be described in detail with reference to the accompanying drawing wherein:

FIG. 1 is a schematic diagram of a steam generator having a circulating type fluidized bed in accordance with the objectives of the invention.

On FIG. 1, steam generator 1 is of a conventional design with regard to the fluid circuits. Feedwater at the working pressure enters the unit through conduit 2 which connects to economizer 10.

Effluent from economizer 10 passes through conduit 12 to drum 13 from whence it passes through conduits 14, 15, 16, 17 and 18 to lower waterwall headers which supply the furnace and convection pass waterwalls 19*f*, 19*r*, 20*f*, 20*r* and 89. The waterwalls, including sidewalls, floors and roof are of the membrane type. Waterwalls 19*f*, 20*f* and 20*r* discharge to drum 13. Rear furnace wall 19*r* is connected to drum 13 through conduit 21. Hopper floor 89 is connected to drum 13 through conduit 90.

Chemical treatment of the feedwater for steam generator 1 of FIG. 1 is of the volatile type for high pressure service which minimizes formation of solids in the steam generator water circuits.

Baffle 22 within drum 13 directs the steam and water mixture to separators 23. Separated water exits from the bottom of separator 23 and joins with the feedwater from conduit 12 and is recirculated downward through conduit 14. Separated steam passes through the top of separators 23, through baffles and up through outlet screens 24 to conduit 41.

Steam from drum 13 passes through conduit 41 to the inlet header of primary superheater 3. Steam exits from the primary superheater 3 through conduit 25 to desuperheater 218 and superheaters 26 and 28 and out through conduit 29 to a steam consumer (not shown). Spray water can be injected into desuperheater 218 through spray nozzle 220. Conduit 27 connects superheaters 26 and 28.

Water level WL in drum 13 is maintained at a fixed set point by control of feedwater flow through conduit 2.

Combustor 30 is of the fluidized type wherein particles of fuel and inert material are dispersed throughout the bed by agitation.

Primary air fan 31 takes air from atmosphere through inlet vanes 32 which control air flow. Primary air fan 31 discharges through duct 33 and shutoff damper 34 (for isolation purposes) to air heater 8*a*. The hot air then passes through duct 33*a* to plenum chamber 35.

Plenum chamber 35 feeds primary air to combustor 30 through sized holes in the floor 202 of combustor 30.

Primary fuels, as coal, are fed to combustor 30 through conduit 37. Where $SO_2$ removal is required, limestone or equivalent is injected with the fuel through conduit 37. Secondary fuels as trash and waste products may enter combustor 30 along with the primary fuel through conduits 37 and 38.

Ignition begins in the lower portion of combustor 30 and as the particles of fuel and inert material rise in the base of the bed through displacement by fuel, limestone and inert material which are added through conduit 38, all in a fluidized state, they reach the level at which ports 39 are located. Ports 39 are close to the base of the bed. Ports 39 supply secondary air/gas flow which generates gas velocity in the furnace 40 at this point sufficiently high to entrain desired quantities of bed solids in the gas stream, carrying such solids upward into furnace 40.

Supplemental air fan 66 takes air from atmosphere through inlet vanes 67 and discharges through duct 68 to air heater 8*b*, through ducts 68*a* and 68*b* to duct 74 and ports 75. Ports 75 supply tertiary air/gas to the upper portion of furnace 40 for control of gas temperature at the outlet of furnace 40.

Dampers 76 and 77 proportion supplemental air flow to secondary gas ports 39 or tertiary air ports 75 respectively. Inlet vanes 67 control total supplemental air flow.

Gas from plenum 11 is drawn through conduit 60 to gas recirculation fan 61. Dampers 62 are for isolation purposes. Damper 63 is for total gas flow control. Gas recirculation fan 61 discharges through duct 65 and proportioning damper 64 to secondary ports 39 or through duct 42 and proportioning damper 42*a* to tertiary gas ports 75.

The furnace walls in the vacinity of the tertiary air ports 75 may be studded and lined with refractory 78 to accelerate combustion in the area of refractory 78 and assist in the elevation of gas temperature at the outlet of furnace 40.

Ports 75 assist in raising the level of furnace outlet gas temperature to a value as 1,660° F. to increase heat transfer in downstream surface 26, 28, 3 and 10 while maintaining gas temperature in the combustor 30 and area immediately above at a level as 1550° F.

Fuel is added to combustor 30 through conduit 38 and at this point it is thoroughly mixed throughout the bed.

Air is admitted to combustor 30 through sized holes in floor 202 from plenum 35. The direction of air flow over floor 202 cools floor 202. This flow is only a portion of the total air flow required for combustion purposes. Additional air is added through secondary ports 39 and tertiary ports 75. Controlled air flow through the various points of entry (202, 39 and 75) regulates combustion rate in the associated furnace zones and assists in control of bed temperatures in these zones.

Gas recirculation flow through ports 39 and 75 supplements air flow and maintains gas velocity sufficiently high to entrain desired amounts of recirculated solid particles in the gas stream throughout the load range. Gas recirculation supplements or complements use of supplemental air for control of furnace gas temperature as well as balances heat absorption between evaporating and superheating duties.

Gas temperature above ports 39 is measured by thermocouple 84 and gas temperature above ports 75 is measured by thermocouple 85.

There is a gas velocity increase as the gas enters surface 26 and 28 serially after it leaves furnace 40. As heat is transferred from the gas and solid particles to the tube surfaces 26 and 28, gas temperature decreases. This reduces the specific volume of the gas as well as the gas velocity for a given cross section area of the gas path.

The volumetric relationship within plenums 43 and 44 is such to permit the gas velocity to drop below entrainment level for the bulk of the solid particles entrained in the gas stream at the outlet of platens 28. This permits settlement of the solid particles which fall downward into hopper 50.

Gas passes from plenum 43 to plenum 44 through rear furnace wall tubes 19*r* and floor 89 riser tubes, at which points the membranes are lacking and alternating tubes have been spread apart sufficiently to permit free passage of gas.

The tube configuration of surface 28 is such at the top of the bank to assist in uniform distribution of gas flow to plenums 43 and 44.

Gas flows upward to the top of plenums 43 and 44 where it exits through ports or orifices 45.

Ports 45 are located in the roof plane 20*f* and are formed by upsetting individual tubes for specified lengths from the plane of the tube and membrane sheet. Where the welded-in membranes are of sufficient width, slots 45 can be formed by the omission of the membranes in specified locations.

Ports 45 are spaced and sized to create uniform gas distribution up through plenums 43 and 44. The overall configuration is such to avoid turbulence in the gas path as the gas flows from tube bank 28 through plenums 43 and 44 to ports 45.

Duct 73*a* ia formed by the continuation of walls 20*f* and 20*r*, with a space inbetween, over plenums 43 and 44. The walls 20*f* and 20*r* are of the membrane type for a tight enclosure. The sidewalls are an integral part of duct 73*a*.

Plenum 73*b* gas flows through primary superheater 3 and economizer 10 platens to plenum 11.

Solid particles collected in plenum 11 fall to hopper 47. Rotary feeder 49 is power driven and feeds dust from hopper 47 to recirculated particle feeder 48 through conduit 49*a*. Rotary feeder 49 is provided with a displacement type of seal to prevent reverse flow.

Gas from plenum 11 passes through duct 4 to air heater 8*a* and 8*b*.

Air heaters 8*a* and 8*b* are provided with tube sheets 52 in which tubes 53 are mounted. The gas from duct 4 passes through tubes 53 to duct 54. Primary air fan 31 and supplemental air fan 66 discharge air flows around tubes 53. Gas duct 54 connects to bag house 5 where dust collection is completed. Dust separated in the bags is removed through conduits 55.

Bag house 5 discharges through duct 56 to I.D. fan 6 and duct 57 to stack 7 and from thence to atmosphere. Dampers 58 and 59 are for isolation purposes and to regulate flow of gas so as to maintain a slightly negative pressure in furnace 40.

The walls of hopper 50 are formed by water cooled floor 89, rear pass waterwall 20*f* and associated water cooled sidewalls.

The hot separated fuel and inert solid particles which fall onto the horizontal projected surface of floor 89 and rear pass waterwall 20*f* at the bottom of plenums 43 and 44 transfer heat at high rates to these surfaces since the solid particles are in direct contact with the metal tubular heat exchange surface through which coolant flow is passed. At the anticipated particle temperature (1,500° F.), the particles are dry, not sticky and are free flowing. The temperature of the particles (ash) is below the softening and deformation temperature. They are hot and glowing. The hot particles tumble down along tubular surface 20*f* and 89 on their way to hopper 50. Hopper 50 is constructed so that the particles are in a dense, compact association with the hopper walls.

In the configuration shown, a substantial amount of evaporation takes place as a result of the high rate of heat transfer between the hot separated particles and water cooled tubular surface 20*f* and 89.

Floor 51 of hopper 50 is sloped downward in the direction of flow which is toward discharge conduit 46. Air distribution plates 36 are mounted on top of floor 51. Floor 51 is provided with holes (not shown) uniformly spaced over the surface on close centers as 2 inches to supply air to distribution plates 36 above.

Blower 9 takes air from atmosphere and pressurizes it. The pressurized air discharges through conduit 69 to plenum 86 where it is distributed through holes in floor 51 to distribution plates 36 mounted on floor 51.

Distribution plates 36 are porous and the flow of air up through them permeates the mass of solid inert particles immediately above floor 51, fluidizing the solid particles to the point of permitting them to slide down floor 51 incline and dump into discharge conduit 46 from whence they feed to recirculated particle feeder 48 for recycle to combustor 30 through conduit 38.

Blower 9 is provided with relief means (not shown) to permit discharge air flow from blower 9 to vary as a consequence of the throttling action of control means 87.

Modulation of flow control means 87 permits regulation of the rate at which inert material particles spill over from hopper 50 to discharge conduit 46. Flow control means 87 incorporates power actuated means 93 which is responsive to hopper 50 level controller 222. Controller 222 is responsive to multiple levels as 88*a*, 88*b* and 88*c*. Measurement of solid particle density at point 226 is also factored into level controller 222. Low density is over-riding. It accelerates removal of solids from hopper 50 and retards removal of ash from combustor 30 through conduit 72 (not shown) if the level of hopper 50 is low.

As a result of the heat given up by the solid particles to surface 89 and 20*f*, the particles must be reheated after they are returned to combustor 30. This requires an increase in firing rate which can be accomplished without raising the temperature of the bed above set point. The net effect of the regenerative heating function of the recirculated solid particles is to make available more high temperature energy to the steam generator fluid circuits. This is important in the case of units having substantial superheating and reheating requirements at high pressure. This normalizes the configuration of the low temperature end of the circulating fluidized bed boiler.

The recirculating loop of the circulating fluidized bed combustion system can be described as follows: the combustor 30 contains a bubbling bed below ports 39 which serves as a classifier/igniter. The lower bed overflows above the secondary gas ports 39 by addition of fuel, limestone and recirculated particles through conduit 38. Gas flow through ports 39 lifts the recirculated bed materials up into furnace 40 as a result of furnace gas velocities in the entrainment range (16 to 25 foot/-second). The lower part of the furnace functions as a pulverizer. Solid particles carried over into plenums 43 and 44 are collected in hopper 50 as gas velocity in plenums 43 and 44 drops below entrainment value (4 to 8 foot/second). Hopper 50 collects separated solid material after heat exchange with circuits 20*f* and 89.

Solids from hopper 50 are discharged into conduit 46 which connects to recirculated particle feeder 48 below. From feeder 48, solid particles pass through conduit 38 and back to combustor 30 for recycle.

Recirculating solid particle feeder 48 consists of a vibrating plate 70 which is driven by variable speed means 71 to cause solid particles in conduit 46 to pass through feeder 48 at a preset rate. Variable speed means 71 receives inputs from a sonic density and flow measuring device incorporated as part of the variable speed control. The type of feed device is not a specific part of this invention.

Ash can be removed from the circulating loop through the opening at the bottom of combustor 30 through conduit 72. Ash is removed on a continuous basis to maintain equilibrium in the combustion system. Methods are know for removal of ash from combustor 30 at a controlled rate on a continuous basis. A counterflow of gas up through conduit 72 will classify the size of the ash particles removed from combustor 30 through conduit 72. The greater the counter flow, the more dense and larger will be the material which passes through.

Oil or gas can be admitted through conduit 81, flow control means 82 and nozzles 83 into combustor 30 for firing during unit startup or for use as a supplemental or emergency fuel during times when solid fuel supply has been interrupted. Nozzles 83 are equipped with ignition means.

FIG. 1 is representative of an actual working design for a steam generator which was developed to illustrate the principles of the invention and the application to which this application is a continuation-in-part. Calculated performance data is as follows:

| | |
|---|---|
| Evaporation | 450,000 lb/hr |
| Pressure at suphtr. outlet | 1,500 psig |
| Temp. final suphtr. outlet | 950° F. |
| Temp. primary suphtr. outlet | 740° F. |
| Temp feedwater at econ. inlet | 258° F. |
| Gas temperatures: | |
| Primary furnace zone | 1,550° F. |
| Secondary air/gas zone | 1,550° F. |
| Furnace outlet | 1,662° F. |
| Primary suphtr. inlet | 1,500° F. |
| Economizer inlet | 1,159° F. |
| Air heater inlet | 703° F. |
| Air heater outlet | 300° F. |
| Air temperatures: | |
| Inlet | 80° F. |
| Air heater outlet | 500° F. |
| Heat input to furnace | 652,765,000 Btu/hr |
| Fuel fired (waste anthracite coal) | 76,823 lb/hr |
| Combustion air | 610,622 lb/hr |
| Flue gas econ. outlet | 655,820 lb/hr |
| Spray water | 9,963 lb/hr |
| Excess air | 25% |
| Recirculated solids at furn. outlet | 2,437,200 lb/hr |
| Mass flow ratio recirc. solids:gas | 3.66:1 |
| Design gas velocity at furn. outlet | 18 ft./sec. |
| Heat transfer summary: Millions Btu/hr | |
| Economizer | 75.000 |
| Ash cooling after separation | 88.610 |
| Waterwall enclosure | 19.629 |
| Furnace | 229.735 |
| Primary superheater | 65.876 |
| Intermed. & final superheater | 76.000 |
| Total heat transfer | 554.850 |

For a second type of working design for a smaller steam generator having a rating of 100,000 lb/hr employing forced circulation in parallel with natural circulation and wherein recirculated solids (ash) are separated at the economizer inlet at which point the design gas temperature is 725° F. (recirculated ash cooled from 1,550° F. to 725° F.), calculated performance data is as follows:

| | |
|---|---|
| Evaporation | 100,000 lb/hr |
| Press at suphtr. outlet | 900 psig |
| Temp. at suphtr. outlet | 850° F. |
| Feedwater inlet temp. | 228° F. |
| Economizer outlet temp. | 354° F. |
| Gas temperatures: | |
| Superheater inlet | 1,550° F. |
| Inlet to evaporation platens | 1,285° F. |
| Inlet to economizer | 725° F. |
| Outlet of economizer | 320° F. |
| Combustion air | 135,033 lb/hr |
| Flue gas leaving economizer | 147,240 lb/hr |
| Excess air | 25% |
| Heat input to furnace | 144,353,000 Btu/hr |
| Recirc. solids at furn. outlet | 296,280 lb/hr |
| Massflow ratio recirc. solids:gas | 2.01:1 |
| Design gas vel. at furn. outlet: | 16 to 19 ft/sec. |

For both steam generators recirculated particulate was held at a minimunm for controlling furnace combustion temperature at 1,550° F. during the design process. For the second case the recirculated ash was cooled a substantially greater amount than was contemplated for the first case. Consequently the mass flow ratio for the second case was lower when compared to the first case (2.01 to 3.66:1). It is anticipated that the recirculated solids (ash) may increase above the minimum level under actual working conditions. A range of between 2:1 and 6:1 for the mass flow ratio and between 1,400° F. and 1,750° F. for the reactor/furnace combustion temperature are practical working parameters for achieving the objectives of this invention.

In both cases flue gas velocities at the furnace outlet were in a range of 16 to 25 ft/sec. which is considered appropriate for the applications illustrated to minimize tube surface erosion.

Prior art indicates that the solids circulating in a fluidized bed reactor of similar character were maintained at constant temperature and at high mass flow rates. In certain cases the apparatus was principally intended for processing of ores. Refractory lined cyclones separated the solids from the gas stream. Where the reactor was refractory lined external cooling was needed.

The external heat exchanger was initially used as a substitute for reactor waterwall cooling. Steam production was incidental to the process. The external heat exchanger was not used to reduce the quantity of solid materials recirculated, especially for ore processing applications as calciners.

For example, U.S. Pat. No. 4,165,717 specifies that the solids density above the location at which secondary gas is introduced should be in a range of from 15 to 100 kg/m$^3$ with the density decreasing over the reactor height. Another reference in the same case considers the specified density range to be a mean value. The volume and velocity of the flue gas is adjusted to control the solids density within the specified range. No adjustment is made as regards particle size of the fuel or inert material admitted to the bed or of gas velocities required to minimize erosion effects of the solids upon tubular heat exchange surface. In certain cases the reactor was refractory lined and heat exchange wth a coolant in the reactor walls was not an issue.

Prior art does not relate to particle sizes recirculated, the mass of material recirculated, the gas velocity in the reactor/furnace or the recirculated solids to gas mass flow ratios at the reactor/furnace outlet. While the densities stated in U.S. Pat. No. 4,165,717 tend to be indeterminate with respect to location, the stated densities at some point are in a range of from 0.94 to 6.24 pounds per cubic foot which is a wide range for variance.

In the case of the present invention, assuming a minimum recirculated solid particle velocity of 7 feet per second, the solids density at the furnace outlet is specified to be in a range of from 0.210 to 0.096 pounds per cubic foot.

The amount of material in static suspension in the furnace is not a part of this invention. The material which is statically suspended in the reactor/furnace has little influence upon the cooling of the furnace gases after it reaches equilibrium temperature other than to accelerate heat transfer rate through fluid cooled reactor/furnace walls or platens. Such factor only influences the amount of furnace wall heat exchange surface required.

The present invention concentrates upon potential longivity of heat exchange platens suspended in a gas stream which transports entrained solid particles. Entrained solids at low density at a conservative velocity in the flue gas stream accelerates heat transfer rates in expensive high temperature superheating and reheating platens.

Acceleration of heat transfer rates in the furnace on the other hand can reduce furnace volume below desirable limits resulting in excessive flue gas velocities. In such case the entrained solids are highly abrasive with regard to heat transfer surface immersed in a flue gas stream laden with entrained solid particles of inert material.

The present invention distinguishes between those requirements suitable for an ore processing calciner as compared with the special needs of a combustion system designed for servicing a steam generator wherein steam is the sole product of the process.

The control system illustrated in the U.S. Patent application to which this application is a continuation-in-part is representative of a control system which would be utilized for FIG. 1 steam generator.

Excess air as measured by $O_2$ measuring device/controller 112 is used to bias air & gas recirculation flow to furnace 40. Air and gas recirculation flow is measured at stations 104, 79, 80 and 195 and summated and characterized to maintain flue gas velocity at the furnace outlet within the specified range according to the invention.

The rate of flow of recycled solid particles through the loop is controlled by solid particle feeder 48.

It is to be understood that a control system cannot force a steam generator to conform to the operational parameters established by the invention. Rather, the steam generator is to be designed structurally so that such operational parameters are a natural result of operating the unit. Design air, gas, fuel and recycled particulate flows, disposition of the heat transfer circuits and gas path along with dimensions of the overall structure must be coordinated to achieve the objectives of the invention.

Thus, it will be seen that I have provided an efficient embodiment of my invention whereby means are provided for a steam generator circulating fluidized bed combustion system to maintain circulation in the bed at a level only sufficient to inhibit the bed temperature to a preset temperature set point, the recirculated solid inert material is cooled to further reduce the amount of solids recirculated, cooling may be accomplished through heat exchange surface in the combined stream of gas and solid particles before separation and/or after the point of separation, a low mass flow ratio of recirculated solids to gas at the furnace outlet in a range of from 6:1 to 2:1 used for bed cooling when maintaining conveying gas velocities at the same point in a range of 16 to 25 feet per second minimizes erosion of coolant filled tubular heat exchange surface exposed to the solids bearing gas stream, and combustion air flow is limited at partial load through the recirculation of cooled spent flue gas through the circulating combustion path to maintain entrainment gas velocities.

While I have illustrated and described several embodiments of my invention, these are by way of illustration only and various changes and modifications may be made within the contemplation of my invention and within the scope of the following claims:

I claim:

1. An apparatus for minimizing mass flow of solid material recirculated in a steam generator circulating fluidized bed which comprises:

means defining a steam generator with combustion system in which minimum recirculation of solid materials is carried out;

a fluid coolant circuit as part of said steam generator having serially connected economizer, waterwalls and superheater and wherein a steam drum may optionally be disposed between said waterwalls and said superheater;

means for combustion of a solid fuel in association with inert solid particles within a vertical reactor/-furnace, presence of said inert solid particles in said means for combustion suppressing said combustion temperature;

the walls of said vertical reactor/furnace comprising portion/s of said fluid coolant circuit;

first inlet means for combustion air located in the bottom portion of said reactor/furnace for partially combusting and fluidizing said solid fuel and inert particles;

second inlet means for admission of supplemental air/gas flow to said reactor/furnace at level/s above said first inlet means adapted to entrain a substantial portion of said solid fuel and inert material particles in a flue gas stream produced by said means for combustion and to maintain velocity of said flue gas stream at said reactor/furnace outlet in a range of from 16 to 25 feet per second and at rated conditions of said steam generator;

means for separating particles of solid materials in said flue gas from said flue gas downstream of said reactor/furnace as substantially inert material;

means for recycling said separated particles to said means for combustion and for association with said solid fuel;

means for removing said substantially inert material from said solid material recirculation circuit including means for regulation of the mass flow rate of said solid materials recirculated through said reactor/furnace outlet;

means to cool said circulating solid materials after said reactor/furnace outlet and before recycle to said means for combustion;

said means to cool said circulating solid materials having cooling capacity sufficient to maintain said reactor/furnace combustion temperature in a range of from 1,400° F. to 1,750° F. when the ratio of said mass flow rate of said solid materials to said flue gas at said reactor/furnace outlet and at rated conditions of said steam generator is in a range of from 6:1 to 2:1.

2. An apparatus as recited in claim 1 and which additionally comprises:

means for delivery of cooled flue gas, after separation of said particles of solid materials, to said second inlet means and including a blower or fan having means for controlling rate of gas flow.

3. An apparatus as recited in claim 2 and which additionally comprises:

means for delivery of air to said second inlet means with means for controlling rate of air flow and wherein at least a portion of said supplemental air/gas comprises said air.

4. An apparatus as recited in claim 1 and wherein:

said means to cool said circulating solid materials comprises a superheater portion of said steam generator fluid coolant circuit located in said flue gas stream at the reactor/furnace outlet, said superheater portion being spaced, in platen form, at intervals across said flue gas stream.

5. An apparatus as recited in claim 1 and wherein:

said means to cool said circulating solid materials receives said solid materials after separation from said flue gas stream allowing a dense solid particle association with said means to cool.

* * * * *